US011197548B2

(12) United States Patent
Theesfeld et al.

(10) Patent No.: US 11,197,548 B2
(45) Date of Patent: Dec. 14, 2021

(54) RECLINING CONTROL SYSTEM FOR A CHAIR

(71) Applicant: Allseating Corporation, Mississauga (CA)

(72) Inventors: Jeffery T. Theesfeld, East Greenville, PA (US); Shaun J. Smith, Harleysville, PA (US); Timothy J. Weaver, Boyertown, PA (US); Aaron Duke, Orangeville (CA)

(73) Assignee: ALLSEATING CORPORATION

( * ) Notice: Subject to any disclaimer, the term of this patent is extended or adjusted under 35 U.S.C. 154(b) by 0 days.

(21) Appl. No.: 16/715,406

(22) Filed: Dec. 16, 2019

(65) Prior Publication Data

US 2021/0177144 A1 Jun. 17, 2021

(51) Int. Cl.
*A47C 1/032* (2006.01)

(52) U.S. Cl.
CPC ..... *A47C 1/03255* (2013.01); *A47C 1/03261* (2013.01); *A47C 1/03205* (2013.01)

(58) Field of Classification Search
CPC ..... A47C 1/03255; A47C 1/03277; A47C 1/03261; A47C 1/03205; A47C 1/024; A47C 1/03266; A47C 1/03274; A47C 1/03279; A47C 1/03288; A47C 3/025; A47C 3/0252; A47C 3/026; A47C 7/441
USPC ..... 297/285, 300.4, 303.3
See application file for complete search history.

(56) References Cited

U.S. PATENT DOCUMENTS 2,746,520 A * 5/1956 Ducrot ..... A47C 7/52 297/322
2,859,799 A * 11/1958 Moore ..... A47C 1/03272 297/300.5
2,973,027 A * 2/1961 Navelle ..... A47C 1/0355 297/84
3,014,757 A * 12/1961 Pilcher ..... A47C 1/0355 297/85 R
3,297,360 A * 1/1967 Holmstrom ..... A47C 3/026 297/302.1

(Continued)

FOREIGN PATENT DOCUMENTS

WO 1994028770 12/1994

*Primary Examiner* — Kyle J. Walraed-Sullivan
(74) *Attorney, Agent, or Firm* — Lorelei G. Graham

(57) ABSTRACT

A reclining control system for a chair having a back and a seat including a rigid seat member having a bottom surface and a first rigid link having a first end and second end. The first end of the first rigid link may be adapted to engage the back and the second end of the first rigid link may be positioned proximally adjacent to the bottom surface of the rigid seat member. A rigid link may have a first end and a second end, where the first end of the rigid link may engage the bottom surface of the rigid seat member at an engagement point. The second end of rigid link may engage the second end of the first rigid link in an aft position. The reclining control system for a chair may further include a pivoting link having a first end and a second end. The first end of the pivoting link may engage the bottom surface of the rigid seat member at the engagement point and the second end of the pivoting link may engage the second end of the first rigid link in a fore position. The rigid link moves the rigid seat member from a non-reclining position in a downward and backward direction and the pivoting rigid link moves the back to a reclining position.

21 Claims, 5 Drawing Sheets

(56) References Cited

U.S. PATENT DOCUMENTS 4,452,486 A * 6/1984 Zapf ..... A47C 1/03272 297/343
4,577,907 A * 3/1986 Talmon ..... A47C 5/12 297/451.4
4,718,725 A * 1/1988 Suhr ..... A47C 1/03255 297/300.3
4,889,385 A * 12/1989 Chadwick ..... A47C 3/026 297/300.1
4,966,411 A * 10/1990 Katagiri ..... A47C 31/126 297/300.7
5,033,791 A * 7/1991 Locher ..... A47C 7/445 297/302.3
5,039,164 A * 8/1991 Gibbs ..... A47C 3/18 297/302.1
5,050,931 A 9/1991 Knoblock
5,150,948 A * 9/1992 Volkle ..... A47C 1/03255 297/300.5
5,193,880 A * 3/1993 Keusch ..... A47C 1/03277 297/353
5,209,548 A * 5/1993 Locher ..... A47C 1/03261 297/300.4
5,370,445 A 12/1994 Golynsky
5,374,101 A * 12/1994 Wiecek ..... A47C 1/0355 297/75
5,397,165 A * 3/1995 Grin ..... A47C 1/03266 297/300.5
5,599,064 A * 2/1997 Vanderminden, Sr. ..... A47C 3/0252 297/344.21
8,215,710 B2 * 7/2012 Erker ..... A47C 1/03288 297/300.2
2002/0043844 A1 * 4/2002 Hobb ..... A47C 3/026 297/302.3
2002/0109384 A1 * 8/2002 Hansen ..... A47C 1/03261 297/300.1
2003/0234566 A1 * 12/2003 Vanderminden ..... A47C 3/021 297/258.1
2004/0026973 A1 * 2/2004 Sander ..... A47C 1/03294 297/316
2004/0113471 A1 * 6/2004 Rivera ..... A47C 3/021 297/258.1
2004/0119325 A1 * 6/2004 Goodworth ..... A47C 7/44 297/301.1
2006/0006715 A1 * 1/2006 Chadwick ..... A47C 31/003 297/300.4
2008/0084102 A1 * 4/2008 Link ..... A47C 1/03272 297/340
2009/0146476 A1 * 6/2009 Kan ..... A47C 1/03272 297/284.4
2010/0060057 A1 * 3/2010 Ballendat ..... A47C 7/445 297/258.1
2010/0164263 A1 * 7/2010 Malenotti ..... A47C 1/03255 297/300.1
2010/0289309 A1 * 11/2010 Fich ..... A47C 1/03294 297/300.2
2011/0074197 A1 * 3/2011 Okamoto ..... A47C 1/03272 297/300.6
2011/0127820 A1 * 6/2011 Moreschi ..... A47C 1/03255 297/354.1
2012/0056453 A1 * 3/2012 Andoloro ..... A47C 1/0308 297/195.11
2013/0221718 A1 * 8/2013 Kelm ..... A47C 3/00 297/337
2013/0221719 A1 * 8/2013 Costaglia ..... A47C 1/032 297/340
2014/0014806 A1 * 1/2014 Yamamoto ..... A47C 1/03255 248/550
2014/0125104 A1 * 5/2014 Hasegawa ..... A47C 1/03283 297/303.4
2015/0123441 A1 * 5/2015 Duke ..... A47C 7/004 297/300.4
2015/0230608 A1 * 8/2015 Unwalla ..... A47C 1/03255 297/325
2015/0245713 A1 * 9/2015 Desanta ..... A47C 1/03255 297/316
2015/0245714 A1 * 9/2015 Schneider ..... A47C 1/03277 297/300.5
2015/0272328 A1 * 10/2015 Huang ..... A47C 1/03272 297/340
2016/0235203 A1 * 8/2016 Rechtien ..... A47C 1/024
2016/0331137 A1 * 11/2016 Costaglia ..... A47C 31/126
2017/0231394 A1 * 8/2017 Brueske ..... A47C 7/40 297/354.1
2018/0027973 A1 * 2/2018 Ludwig ..... A47C 5/12
2018/0235367 A1 * 8/2018 Ostwald ..... A47C 7/14
2019/0038033 A1 * 2/2019 Schmitz ..... A47C 31/126
2019/0208915 A1 * 7/2019 Donati ..... A47C 7/402
2019/0380497 A1 * 12/2019 Costaglia ..... A47C 1/03255
2020/0054138 A1 * 2/2020 Ye ..... A47C 1/03255
2020/0237095 A1 * 7/2020 Jarnes ..... A47C 1/03294
2020/0268154 A1 * 8/2020 Serena ..... A47C 1/03255
2020/0268155 A1 * 8/2020 Brais ..... A47C 1/03277
2020/0315355 A1 * 10/2020 Shibamoto ..... A47C 7/443
2020/0367655 A1 * 11/2020 Ballendat ..... A47C 1/03255

* cited by examiner

RECLINING CONTROL SYSTEM FOR A CHAIR

TECHNICAL FIELD

The application relates generally to chairs and, more particularly to the ability to control the reclining action of a chair back relative to the chair seat.

BACKGROUND

Reclining chairs have mechanism or assemblies which allow a user to recline or lean back while their back remains supported. Typical reclining or tilting controls for chairs are mechanical devices, which are usually mounted beneath the seat of a chair to control the tilting of a chair when a user leans back in the chair. The control mechanism usually includes a spring, which controls the rate at which the user can tilt the chair rearwardly and which returns the chair to its upright at-rest position when the user stops leaning backward.

Many of these controls result in the tilting of the chair backwards with very little force, but raises the front of the chair seat, creating pressure on the user's legs. These chair controls also require the user to exert considerable force through an extension of the leg and foot to maintain a tilted position for this type of chair. The result is not relaxing to the user.

Some types of seating have attempted to achieve the right support by including flexible portions in the front or back of the seat to alleviate undesirable pressure on the thighs of the user while allowing a flexing action to lean back. This type of action is often an uncontrolled action as well.

One-piece seat-and-back supports for chairs are also known. Although these types of chairs provide flexible seat-and-back support, the seat support itself is not flexible. Typically while the back support is often designed to deflect downwardly and backwardly relative to the seat support in response to an occupant's weight, the seat support is not adjustable. As such these types of designs do not provide the necessary comfort for users especially in work environments when occupied for extended periods of time.

As such it is desirable to have a reclining chair that controls the movement of the both the seat assembly and backrest in a measured fashion as determined by the user.

SUMMARY

In one aspect, there is provided a reclining control system for a chair having a back and a seat a rigid seat member with a bottom surface. The reclining control system further includes a first rigid link having a first end and a second end, wherein the first end of the first rigid link is adapted to engage the back, and the second end of the first rigid link is positioned proximally adjacent to the bottom surface of the rigid seat member.

The reclining control system may further include a second rigid link with a first end and a second end, wherein the first end of the second rigid link engages the back of the chair at an engagement point. The second end of rigid link may further engage the second end of the first rigid link in an aft position.

A pivoting link may be present having a first end and a second end. The first end of the pivoting link may engage the back of the chair at the engagement point and the second end of the pivoting link may engage the second end of the first rigid link in a fore position. The second rigid link may move the rigid seat member from a non-reclining position to a reclining position.

In another aspect, there is provided a reclining control system for a chair having a back and a seat. The reclining control system may include a rigid seat member having a bottom surface and a first rigid link having a first end and second end. The first end of the first rigid link may be adapted to engage the back and the second end of the first rigid link may be positioned proximally adjacent to the bottom surface of the rigid seat member.

The reclining control system for a chair may further include a rigid link with a first end and a second end. The first end of the rigid link may engage the bottom surface of the rigid seat member at an engagement point. The second end of rigid link may engage the second end of the first rigid link in an aft position.

Finally the reclining control system for a chair may further include a pivoting link having a first end and a second end. The first end of the pivoting link may engage the bottom surface of the rigid seat member at the engagement point and the second end of the pivoting link may engage the second end of the first rigid link in a fore position.

Preferably the rigid link may move the rigid seat member and the back from a non-reclining position to a reclining position.

Furthermore the reclining control system for a chair may further include a flexible member that may be C-shaped and adapted to engage the front portion of the bottom surface of the rigid seat member.

Preferably the bottom surface of the reclining control system for a chair may be further defined as having a front portion and a back portion.

In another embodiment the reclining control system for a chair may include a rigid pivoting connecting member and a rigid controlling member which may be connected at the engagement point that can be positioned at the back portion of the rigid seat member thereby forming a triangular linkage.

DESCRIPTION OF THE DRAWINGS

Reference is now made to the accompanying figures in which.

DETAILED DESCRIPTION

Figure 5:
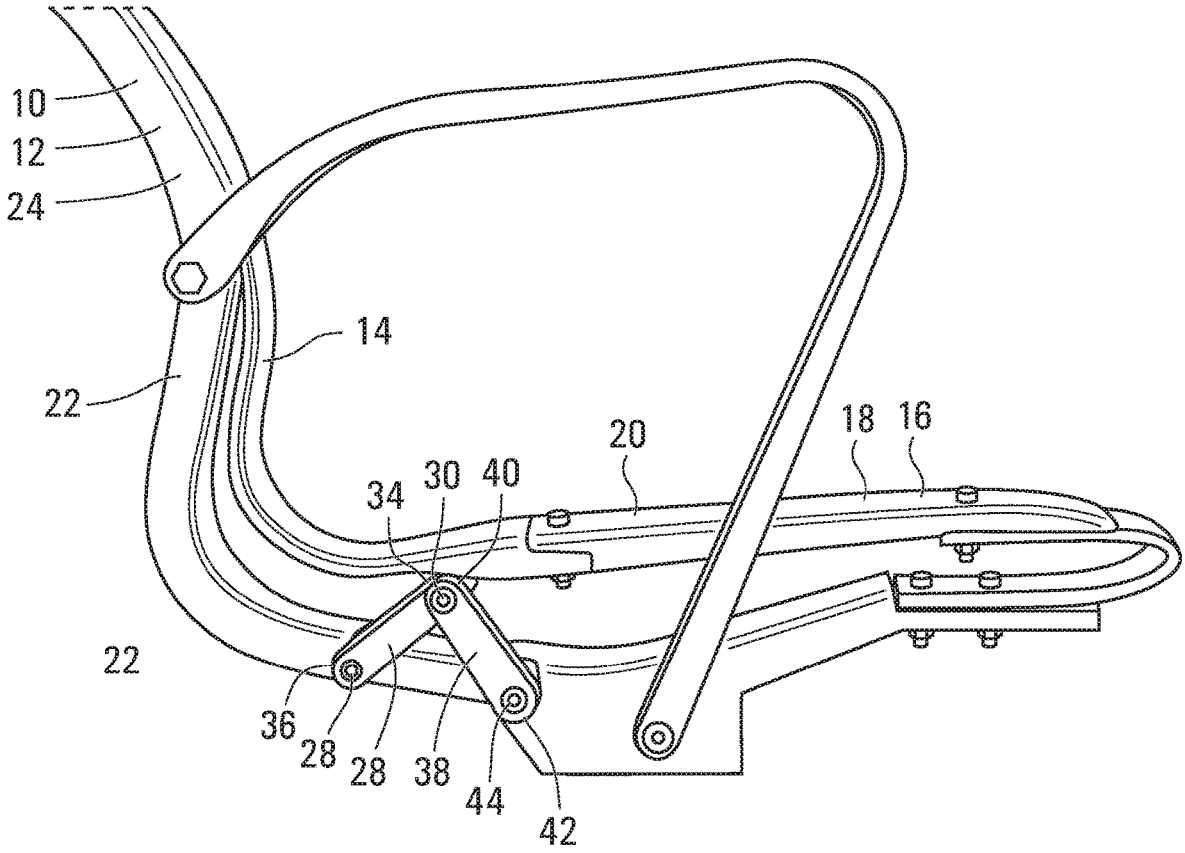
FIG. 5 is a side elevation view of the reclining control system for a chair of FIG. 1.

Referring to FIG. 5 there is illustrated in accordance with a preferred embodiment, a reclining control system 10 for a chair 12 having a back 14 and a seat 16. The reclining control system 10 may include a rigid seat member 18 having a bottom surface 20 and a first rigid link 22 having a first end 24 and second end 26. The first end 24 of the first rigid link 22 may be adapted to engage the back 14. The second end 26 of the first rigid link 22 may be positioned proximally adjacent to the bottom surface 20 of the rigid seat member 18.

The reclining control system 10 for a chair 12 may further include a second rigid link 28 with a first end 30 and a second end 32. The first end 30 of the second rigid link 28 may be adapted to engage the back 14 at an engagement point 34. The second end 32 of second rigid link 28 may engage the second end 26 of the first rigid link 22 in an aft position 36.

The reclining control system 10 for a chair may further include a pivoting link 38 having a first end 40 and a second end 42. The first end 40 of the pivoting link 38 may engage the back 14 at the engagement point 34 and the second end 42 of the pivoting link 38 may engage the second end 26 of the first rigid link 22 in a fore position 44.

The second rigid link 28 may move the rigid seat member 18 and back 14 from a non-reclining position to a reclining position.

Referring to FIGS. 1-4 in another embodiment of the present invention there is provided a reclining control system 10 for a chair 12 having a back 14 and a seat 16. The reclining control system 10 may include a rigid seat member 18 having a bottom surface 20 and a first rigid link 22 having a first end 24 and second end 26. The first end 24 of the first rigid link 22 may be adapted to engage the back 14. The second end 26 of the first rigid link 22 may be positioned proximally adjacent to the bottom surface 20 of the rigid seat member 18.

The reclining control system 10 for a chair 12 may further include a second rigid link 28 with a first end 30 and a second end 32. The first end 30 of the second rigid link 28 may engage the bottom surface 20 of the rigid seat member 18 at an engagement point 34. The second end 32 of second rigid link 28 may engage the second end 26 of the first rigid link 22 in an aft position 36.

The reclining control system 10 for a chair may further include a pivoting link 38 having a first end 40 and a second end 42. The first end 40 of the pivoting link 38 may engage the bottom surface 20 of the rigid seat member 18 at the engagement point 34 and the second end 42 of the pivoting link 38 may engage the second end 26 of the first rigid link 22 in a fore position 44. The second rigid link 28 may move the rigid seat member 18 and the back 14 from a non-reclining position to a reclining position.

In all embodiments, the bottom surface 20 of the rigid seat member 18 may be further defined as having a front portion 46 and a back portion 48. The reclining control system 10 may further include a flexible member 50. The flexible member may be C-shaped and adapted to engage the front portion 46 of the bottom surface 20 of the rigid seat member 18. The C-shaped flexible member 50 may be integrally formed to the rigid seat member 18 whereby the C-shaped flexible member 50 is positioned at the far end of the front portion 46 or forms a front edge 52 of the of the rigid seat member 18.

The C-shaped flexible member 50 may extend proximally and adjacent to the bottom surface 20 of the rigid seat member 18. Furthermore the second end 26 of the first rigid link 22 may extend proximally adjacent to then integrally connect with the C-shaped flexible member 50.

Figure 1:
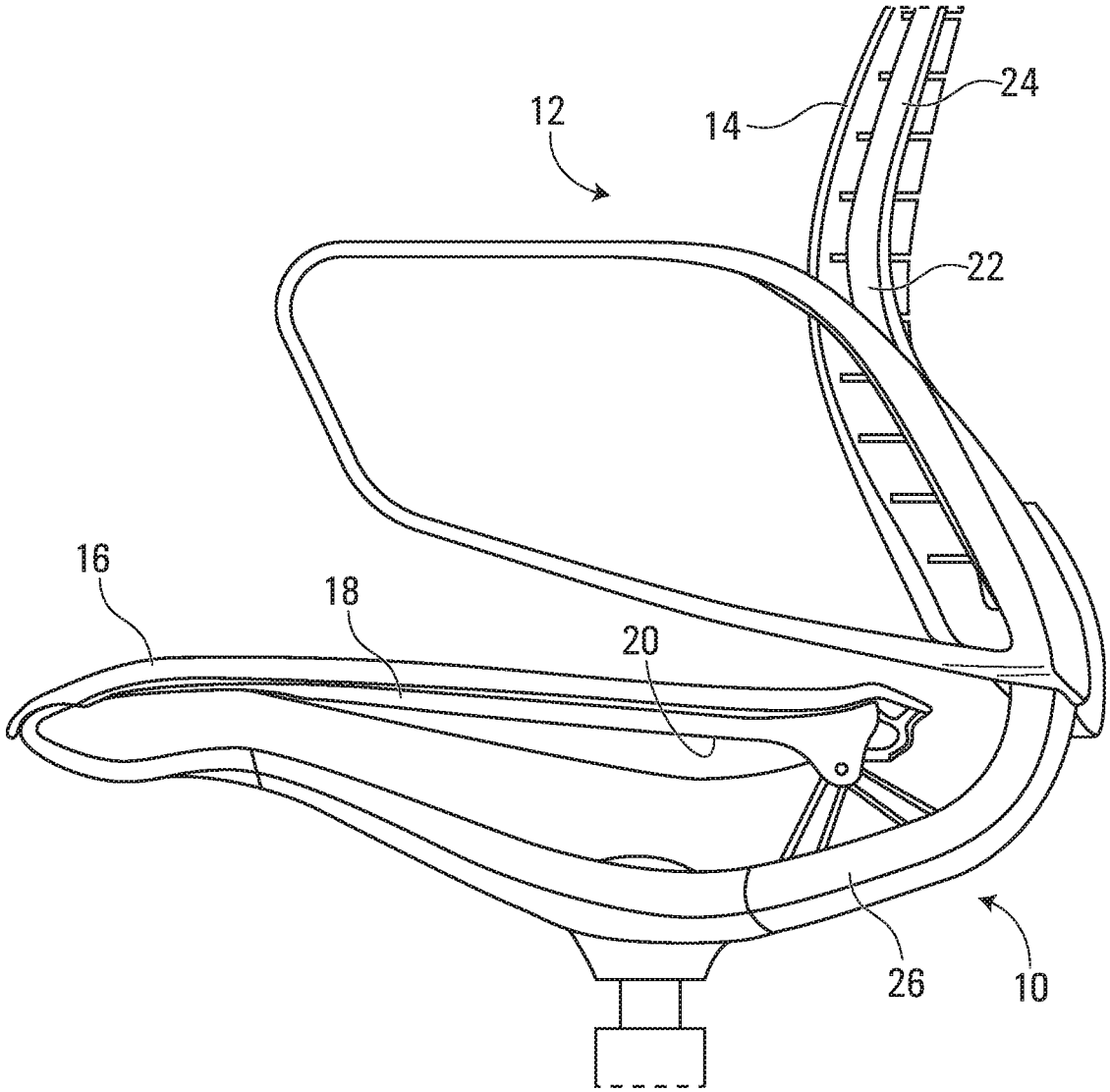
FIG. 1 is a side elevational view of the reclining control system for a chair.
Figure 2A:
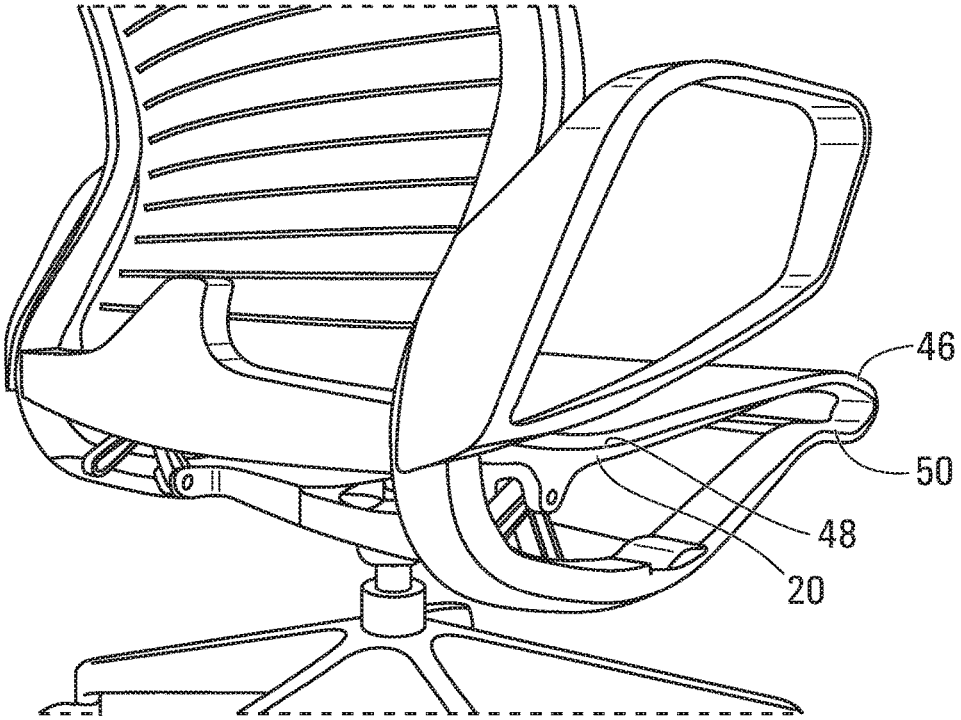
FIG. 2A is a front perspective view of the reclining control system for a chair of FIG. 1.
Figure 2B:
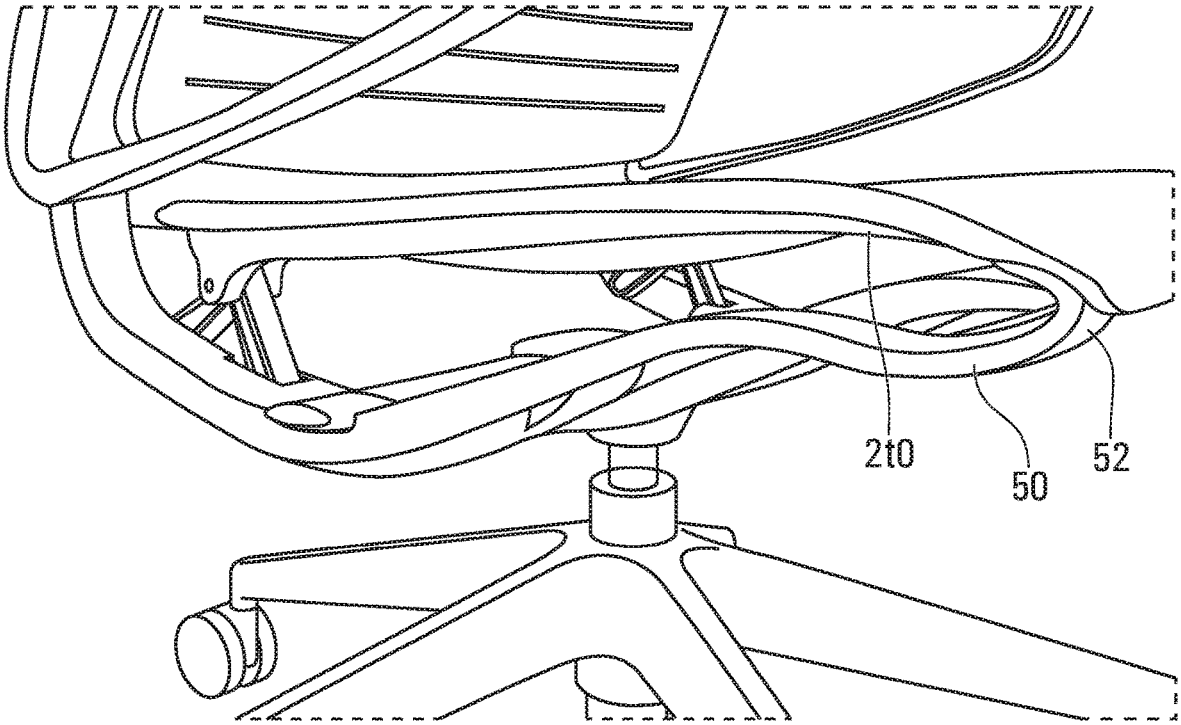
FIG. 2B is a rear perspective view of the reclining control system for a chair shown in FIG. 1.
Figure 3A:
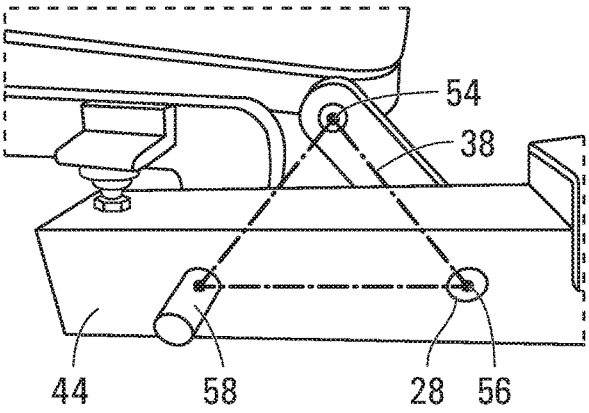
FIG. 3A is a side elevational view of the reclining control system for a chair of FIG. 1.
Figure 3B:
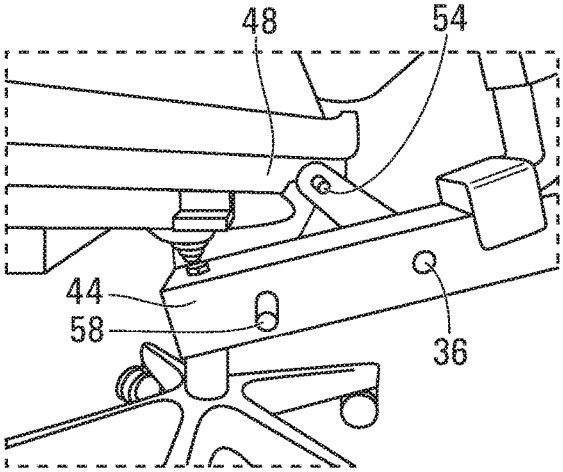
FIG. 3B is a side elevational view of the reclining control system for a chair shown in FIG. 1.
Figure 3C:
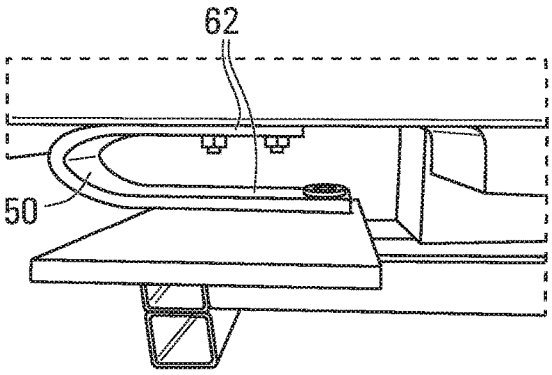
FIG. 3C is a side elevational view of the reclining control system for a chair of FIG. 1.
Figure 3D:
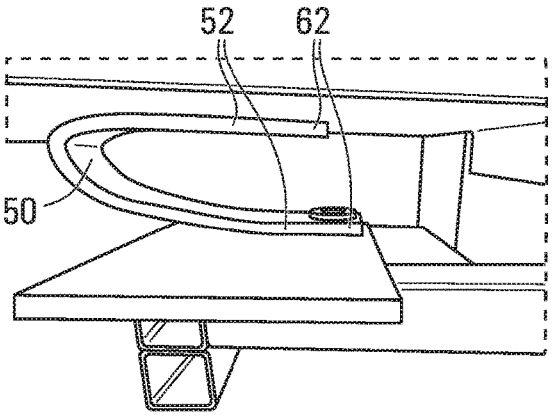
FIG. 3D is a side elevational view of the reclining control system for a chair of FIG. 1.
Figure 4:
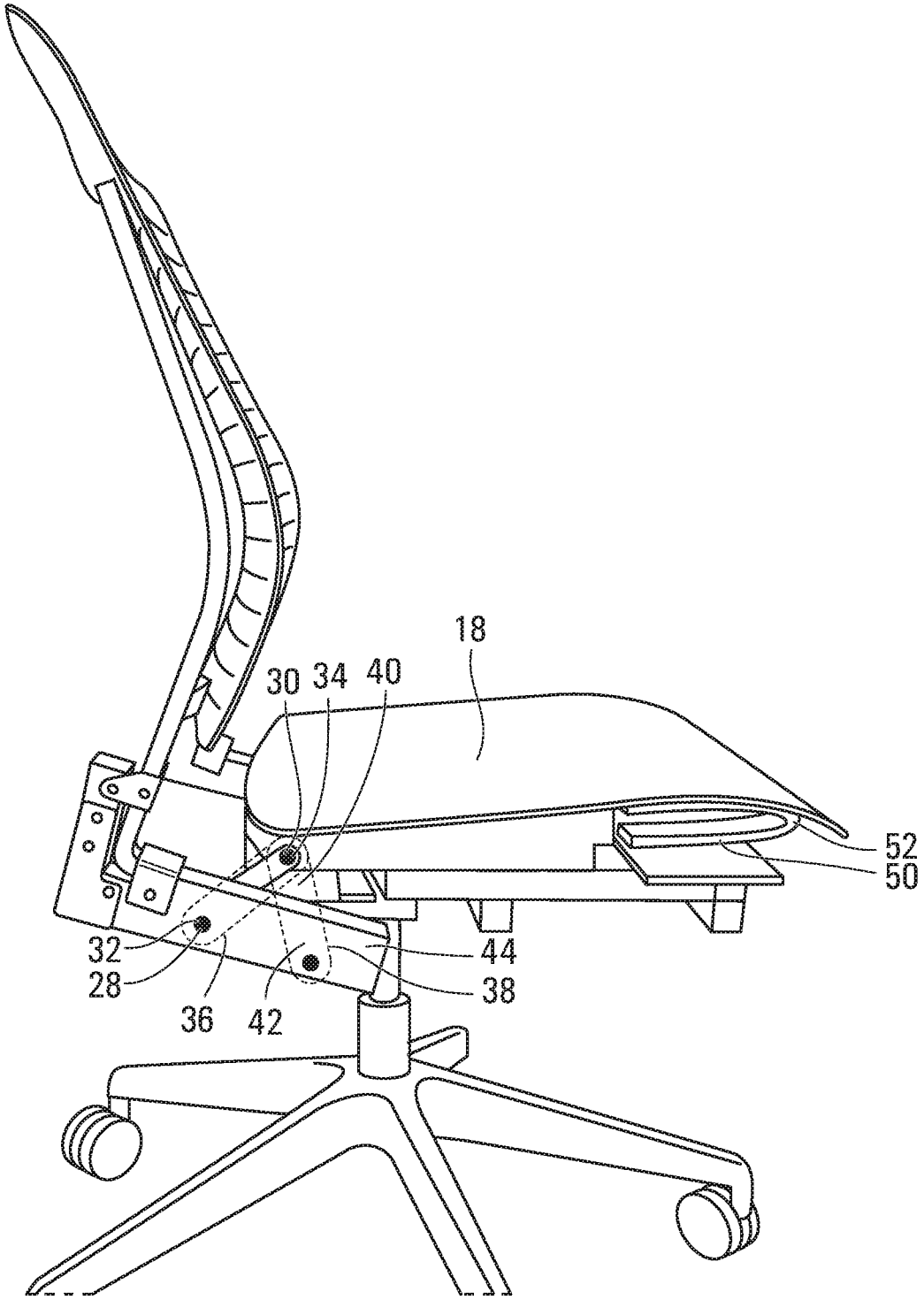
FIG. 4 is a side elevational view of the reclining control system for a chair of FIG. 1.

Referring to FIGS. 3C and 3D, the C-shaped flexible member 50 may be positioned in a compressed position (FIG. 3C) when the rigid seat member 18 is in the non-reclining or sitting position and a user is seated on the seat 16. The seat is therefore primed or loaded by the weight of the user. The C-shaped flexible member 50 may move to an expanded or flexed position (FIG. 3D) when the rigid seat member 18 and the back 14 move to the reclining position.

More specifically the C-shaped flexible member includes at least two arms 62. When the C-shaped flexible member is compressed when the user is sitting on the seat 16 in a non-reclined position, the arms 62 of the C-shaped flexible member 62 move closer toward each other. When the weight of the user moves towards a reclining position, the arms 62 of the C-shaped flexible member 50 expand away from each other and exert a biasing force.

The shape, material, and/or configuration of the flexible member 50 may vary to achieve the functionality disclosed herein. More specifically the C-shaped flexible member 50 may be constructed from a resilient material that allows the C-shaped flexible member 50 to flex up or expand lifting the user's legs that engage the front edge 52 of the of the rigid seat member 18.

Referring to FIGS. 3A and 3B, the second rigid link 28 may be further defined as a rigid connecting member 28 that is adapted to engage at either the back 14 or the back portion 48 of the rigid seat member 18, extending towards the aft position 36 of the second end 26 of the first rigid link 22. As noted above, the first end 30 of the second rigid connecting member 28 may engage either the back 14 or the bottom surface 20 of the rigid seat member 18 at an engagement point 34.

The engagement point 34 may be further defined as a first pivot point 54. The second end 32 of second rigid connecting member 28 may engage the second end 26 of the first rigid link 22 in an aft position 36 at a second pivot point 56. The second pivot point 56 is a fixed position with respect to the rigid seat member 18. In operation, when the user moves to the reclining position, the second pivot 56 does not displace the back 14 or rigid seat member 18, and therefore the back portion 48 of the rigid seat member 18 and the back 14 are reclined by the second rigid connecting member 28.

Referring to FIGS. 3A and 3B, the pivoting link 38 may be furthered defined as a rigid pivoting controlling member 38 that is adapted to engage between back portion 48 of the rigid seat member 18 and the fore position 44 of the second end 26 of the first rigid link 22. As noted above, the first end 40 of the rigid pivoting controlling member 38 may engage the bottom surface 20 of the rigid seat member 18 at the engagement point 34 or the first pivot point 54. The second end 42 of the rigid pivoting controlling member 38 may engage the second end 26 of the first rigid link 22 in the fore position 44 at a third pivot point 58.

In operation, the back 14 and first end 24 of the first rigid link 22 may recline when the rigid pivoting controlling member 38 pivots about the third pivot point 58 at the fore position 44. Specifically rigid pivoting controlling member 38 is rotatable about a pivot axis defined by the third pivot point 58.

As such, both the second rigid connecting member 28 and the rigid pivoting controlling member 38 are connected at the engagement point 34 or the first pivot point 54 positioned at either the back 14 or the back portion 48 of the rigid seat member 18 and the second end 26 of the first rigid link 22, thereby forming a triangular linkage 60.

Specifically, when the triangular linkage 60 is moving between the non-reclining and the reclining position, the second end 32 of the second rigid connecting member 28 and the second end 42 of the rigid pivoting controlling member 38 move away from each other or are spread apart from one another. As such the triangular linkage 60 provides support in both static positions and during movement.

Moreover, the pivoting action of the rigid pivoting controlling member 38 contributes to the controlling of the movement of the back 14 and the back portion 48 of the rigid seat member 18 as it is reclined by the rigid connecting member 28 thereby providing additional stability and control to the reclining action. The triangular linkage 60 therefore helps to form a reclining control system 10 for the chair 12 that is responsive to shifts in the weight of the user, such that the motion of the back 14 and of the seat 16 are linked.

In operation, the user sits in a non-reclining position on the seat 16 and the weight of the user will compress the C-shaped flexible member 50 and specifically the arms 62 of the C-shaped flexible member 50. The weight of the user acts against the triangular linkage 60, namely the second end 26 of the first rigid link 22, the second rigid connecting member 28 and the rigid pivoting controlling member 38 thereby preventing the rotation of the rigid pivoting controlling member 38 about the third pivot point 58.

When the user wishes to recline in the chair 10, the user shifts their weight towards a reclining position against the back 14 of the chair 12. This weight shift causes the rigid pivoting controlling member 38 to pivot downwardly about the pivot axis defined by the third pivot point 58. However during this movement the second pivot 56 does not displace the back 14 or the rigid seat member 18. The second rigid connecting member 28 therefore engages either the back 14 or the back portion 48 of the rigid seat member 18 and actuates the reclining motion.

Since the user has less weight at the front portion 46 or front edge 52 of the rigid seat member 18, the arms 62 of C-shaped flexible member expands providing lift. The seat 16 therefore assumes a slanted or inclined orientation when the back 14 is reclined, where the back portion 48 of the rigid seat 18 is lower than the front portion 46 of the rigid seat member 18.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A reclining control system for a chair having a back and a seat comprising:

a) a rigid seat member having a bottom surface;

b) a first rigid link having a first end and a second end wherein the first end of the first rigid link directly engages the back, and the second end of the first rigid link is positioned proximally adjacent to the bottom surface of the rigid seat member;

c) a second rigid link with a first end and a second end, wherein the first end of the second rigid link engages the back of the chair at a single engagement point and the second end of second rigid link engages the second end of the first rigid link in an aft position, and;

d) a pivoting link having a first end and a second end, wherein the first end of the pivoting link engages the back of the chair at the single engagement point and the second end of the pivoting link engages the second end of the first rigid link in a fore position;

whereby the second rigid link moves the rigid seat member from a non-reclining position to a reclining position.

2. A reclining control system for a chair as claimed in claim 1 wherein the bottom surface of the rigid seat member has a front portion and a back portion and further comprising a flexible member adapted to engage the front portion of the bottom surface of the rigid seat member, the flexible member is a C-shaped flexible member and is integral with the rigid seat member.

3. A reclining control system for a chair as claimed in claim 2 wherein the first rigid link extends proximally adjacent to be integral with the C-shaped flexible member.

4. A reclining control system for a chair as claimed in claim 3 wherein the C-shaped flexible member moves from a compressed position when the rigid seat member is in the non-reclining position to an expanded position when the back is moved to the reclining position.

5. A reclining control system for a chair as claimed in claim 3 wherein the second rigid link is a rigid connecting member adapted to engage between the back of the chair and the aft position of the second end of the first rigid link whereby the back of the chair moves to the reclining position.

6. A reclining control system for a chair as claimed in claim 5 wherein the pivoting link is a rigid pivoting controlling member adapted to engage the back of the chair and the fore position of the second end of the first rigid link whereby the back and first end of the first rigid link recline as the rigid pivoting controlling member pivots about the fore position of the second end of the first rigid link.

7. A reclining control system for a chair as claimed in claim 6 wherein both the rigid connecting member and the rigid pivoting controlling member are connected at the single engagement point positioned at the back of the chair and the second end of the first rigid link in the aft and fore positions respectively thereby forming a triangular linkage.

8. A reclining control system for a chair as claimed in claim 7 wherein the rigid pivoting controlling member rotates about the single engagement point within the triangular linkage when the back moves from the non-reclining position to the reclining position.

9. A reclining control system for a chair as claimed in claim 8 wherein in the reclining position, the back of the chair and the rigid pivoting controlling member move away from each other.

10. A reclining control system for a chair as claimed in claim 9 wherein the rigid pivoting controlling member provides stabilization to the rigid connecting member as the rigid seat member moves to the reclining position.

11. A reclining control system for a chair having a back and a seat comprising:

a) a rigid seat member having a bottom surface;

b) a first rigid link having a first end and a second end wherein the first end of the first rigid link directly engages the back, and the second end of the first rigid link is positioned proximally adjacent to the bottom surface of the rigid seat member;

c) a second rigid link with a first end and a second end, wherein the first end of the second rigid link engages the bottom surface of the rigid seat member at a single engagement point and the second end of the second rigid link engages the second end of the first rigid link in an aft position, and;

d) a pivoting link having a first end and a second end, wherein the first end of the pivoting link engages the bottom surface of the rigid seat member at the single engagement point and the second end of the pivoting link engages the second end of the first rigid link in a fore position;

whereby the second rigid link moves the rigid seat member from a non-reclining position in a downward and backward direction and the pivoting link moves the back to a reclining position.

12. A reclining control system for a chair as claimed in claim 11 wherein the bottom surface of the rigid seat member has a front portion and a back portion and further comprising a flexible member adapted to engage the front portion of the bottom surface of the rigid seat member.

13. A reclining control system for a chair as claimed in claim 12 wherein the flexible member is a C-shaped flexible member and is integral with the rigid seat member.

14. A reclining control system for a chair as claimed in claim 13 wherein the first rigid link extends proximally adjacent to be integral with the C-shaped flexible member.

15. A reclining control system for a chair as claimed in claim 14 wherein the C-shaped flexible member moves from a compressed position when the rigid seat member is in the non-reclining position to an expanded position when the back is moved to the reclining position.

16. A reclining control system for a chair as claimed in claim 15 wherein the second rigid link is a rigid connecting member adapted to engage between back portion of the rigid seat member at the aft position of the second end of the first rigid link whereby the back portion of the rigid seat member moves to the reclining position.

17. A reclining control system for a chair as claimed in claim 16 wherein the pivoting link is a rigid pivoting controlling member adapted to engage between back portion of the rigid seat member and the fore position of the second end of the first rigid link whereby the back and first end of the first rigid link recline when the rigid pivoting controlling member pivots about the fore position of the second end of the first rigid link.

18. A reclining control system for a chair as claimed in claim 17 wherein both the rigid connecting member and the rigid pivoting controlling member are connected at the engagement point positioned at the back portion of the rigid seat member in the aft and fore positions respectively thereby forming a triangular linkage.

19. A reclining control system for a chair as claimed in claim 18 wherein the rigid connecting member and the rigid pivoting controlling member move independently within the triangular linkage when the back moves from the non-reclining position to the reclining position.

20. A reclining control system for a chair as claimed in claim 19 wherein in the reclining position, the second end of the rigid connecting member and the rigid pivoting controlling member move away from each other.

21. A reclining control system for a chair as claimed in claim 20 wherein the rigid pivoting controlling member provides stabilization to the rigid connecting member as the rigid seat member moves to the reclining position.

* * * * *